US006250314B1

(12) United States Patent
Wasserbauer et al.

(10) Patent No.: US 6,250,314 B1
(45) Date of Patent: Jun. 26, 2001

(54) PROCESS OF PICKLING STAINLESS STEEL

(75) Inventors: Brigitta Wasserbauer, Vienna; Edgar Braun, Wien-Rodaun; Gerald Maresch, Mödling, all of (AT)

(73) Assignee: Andritz-Patentverwaltungs-Gesellschaft m.b.H., Graz (AT)

( * ) Notice: Subject to any disclaimer, the term of this patent is extended or adjusted under 35 U.S.C. 154(b) by 0 days.

(21) Appl. No.: 09/353,776

(22) Filed: Jul. 15, 1999

(30) Foreign Application Priority Data

Jul. 15, 1998 (AT) ..... 1217/98

(51) Int. Cl.[7] ..... C23G 3/00

(52) U.S. Cl. ..... 134/3; 134/2; 134/15; 134/26; 134/28; 134/29; 134/30; 134/32; 134/36; 134/40; 134/41; 134/122 R; 134/64 R

(58) Field of Search ..... 134/2, 3, 15, 26, 134/28, 29, 30, 32, 36, 40, 41, 122 R, 64 R

(56) References Cited

U.S. PATENT DOCUMENTS

| | | | | |
|---|---|---|---|---|
| 3,725,527 | * | 4/1973 | Yamamura et al. | 423/139 |
| 3,928,529 | * | 12/1975 | Grulke | 423/138 |
| 4,389,254 | * | 6/1983 | Tusset et al. | 134/3 |
| 4,807,653 | | 2/1989 | Cipriano et al. | 134/64 R |
| 5,154,774 | * | 10/1992 | Bousquet et al. | 134/3 |
| 5,615,727 | | 4/1997 | Ollman | 164/98 |
| 5,702,534 | * | 12/1997 | Rodabaugh et al. | 134/7 |
| 5,786,556 | | 7/1998 | Gronlund et al. | 205/705 |
| 5,800,694 | | 9/1998 | Starcevic et al. | 205/705 |
| 5,804,056 | | 9/1998 | Pempera et al. | 205/661 |
| 5,843,240 | * | 12/1998 | Pedrezzini et al. | 134/3 |
| 5,851,304 | | 12/1998 | Giraud et al. | 134/3 |
| 5,876,522 | | 3/1999 | Figge et al. | 148/545 |
| 5,879,465 | | 3/1999 | McKevitt et al. | 134/3 |
| 5,904,204 | | 5/1999 | Teraoka et al. | 164/417 |
| 5,992,196 | * | 11/1999 | Giraud et al. | 72/39 |

FOREIGN PATENT DOCUMENTS

972854 * 1/2000 (DE) .

* cited by examiner

*Primary Examiner*—Sharidan Carrillo
(74) *Attorney, Agent, or Firm*—Roylance, Abrams, Berdo & Goodman, L.L.P.

(57) ABSTRACT

A process and apparatus for pickling the surface of stainless steel strip feeds the stainless steel strip through a plurality of pickling tanks containing a hydrochloric acid pickling acid. The pickling acid bath is maintained at a temperature of at least about 40° C. An oxidizing agent is added to the acid solution in an amount to maintain at least about one third and preferably at least about half of the soluble iron in the form of ferric chloride based on the total amount of iron in the acid solution.

25 Claims, 3 Drawing Sheets

PROCESS OF PICKLING STAINLESS STEEL

FIELD OF THE INVENTION

The present invention is directed to a process a pickling stainless steel. More particularly, the invention is directed to a process for pickling stainless steel in an acid bath.

BACKGROUND OF THE INVENTION

The process of pickling carbon steel with hydrochloric acid has established itself world-wide over the past few years as an effective pickling process and is used in virtually all countries and steel works. In stainless steel pickling, however, there was always the technical belief that conventional steel pickling methods could not be used for stainless steel because of the different levels and type of scale formation on stainless steel. Surprisingly, however, it was shown that a pickling effect most certainly could be achieved with hydrochloric acid. However, the pickling times required to obtain a scale-free surface on stainless steel using hydrochloric acid are very long compared with carbon steel. A steel strip of grade St 12, for example, is pickled over a maximum of 30 seconds at 80° C., whereas a comparable strip of grade AISI 409 stainless steel takes up to 10 minutes at 90° C. These extremely long pickling times for stainless steel using hydrochloric acid are unsuitable for practical operations because the number and length of tanks needed for pickling would be too great.

During the formation of stainless steel sheet products, a layer of scale is typically produced on the surface of the steel sheet. The scale must be removed, typically by pickling, before the steel can be used or further processed. Many stainless steel pickling baths use a mixture of hydrofluoric acid and nitric acid. The mixture of these acids causes numerous problems associated by the sludge formation of these acids in the tanks. In addition, acid pickling of stainless steel by the conventional process is a very slow process and requires complex treating baths to provide adequate retention time of the stainless steel in the acid bath. The sequential pickling steps result in increased operating costs.

Accordingly, there is a continuing need in the industry for improved methods of pickling stainless steel.

SUMMARY OF THE INVENTION

The present invention is directed to a process and apparatus for pickling stainless steel. More particularly, the invention is directed to a continuous process for pickling a continuous strip of stainless steel in a hydrochloric acid bath in an efficient and economical fashion.

Accordingly, a primary aspect of the invention is to provide a process and apparatus for efficiently pickling stainless steel in an acid bath with reduced pickling times compared to prior processes.

Another object of the invention is to provide a process and apparatus for pickling stainless steel in a hydrochloric acid solution where the solution contains an oxidant.

Another object of the invention is to provide a process and apparatus for pickling stainless steel in a hydrochloric acid solution where an oxidant is added to the acid to oxidize at least a portion of the dissolved iron to ferric chloride.

Another object of the invention is to provide a process and apparatus for pickling stainless steel in an aqueous hydrochloric acid solution where an oxidant is added to the hydrochloric acid solution in an amount based on the calculated dissolved iron content in the acid solution.

Still another object of the invention is to provide a process and apparatus for pickling stainless steel in an aqueous hydrochloric acid solution where at least one third of the soluble iron content in the acid solution is present in the form of ferric chloride.

Another object of the present invention is to provide a process and apparatus for pickling stainless steel in an aqueous hydrochloric acid solution where at least one half of the soluble iron content in the acid solution is present in the form of ferric chloride.

A further object of the invention is to provide a process for pickling stainless steel in an aqueous hydrochloric acid solution at a temperature of at least 40° C.

A further object of the invention is to provide a process for pickling stainless steel in an aqueous hydrochloric acid solution at a temperature at or below the boiling point of an azeotropic hydrochloric acid solution.

Another object of the invention is to provide a process of pickling stainless steel in an aqueous hydrochloric acid solution where the ferric chloride content in the acid solution is measured and an oxidant is added to the solution in an amount based on the measured ferric chloride content Still another object of the invention is to provide a process and apparatus for pickling stainless steel in an aqueous hydrochloric acid solution where an oxidant is added to the solution in an amount based on the weight or surface area of the stainless steel strip being pickled.

The objects of the invention are basically obtained by providing a process for pickling stainless steel comprising the steps of feeding a stainless steel article into a bath of an aqueous hydrochloric acid solution and continuously adding an oxidant to the hydrochloric acid solution in an amount in proportion to the surface area to the stainless steel article to maintain at least about one third of the dissolved iron content as ferric chloride.

The objects of the invention are further obtained by providing a process for pickling a stainless steel strip comprising the steps of providing a plurality of pickling tanks arranged in series where each tank contains an aqueous hydrochloric acid solution, feeding a continuous stainless steel strip through the hydrochloric acid solution in each of said tanks to pickle the surface of the strip, and continuously adding an oxidant to the hydrochloric acid solution in each of the tanks in an amount to oxidize $Fe^{2+}$to $Fe^{3+}$and to maintain a ferric chloride content of at least about one third based on the total dissolved iron content of the acid solution.

Other objects, advantages and salient features of the invention will become apparent from the following detailed description which in conjunction with the annexed drawings disclose a preferred embodiment of the present invention.

BRIEF DESCRIPTION OF THE DRAWINGS

The following is a brief description of the drawings which form a part of this original disclosure, in which.

DETAILED DESCRIPTION OF THE PREFERRED EMBODIMENTS

Figure 1:
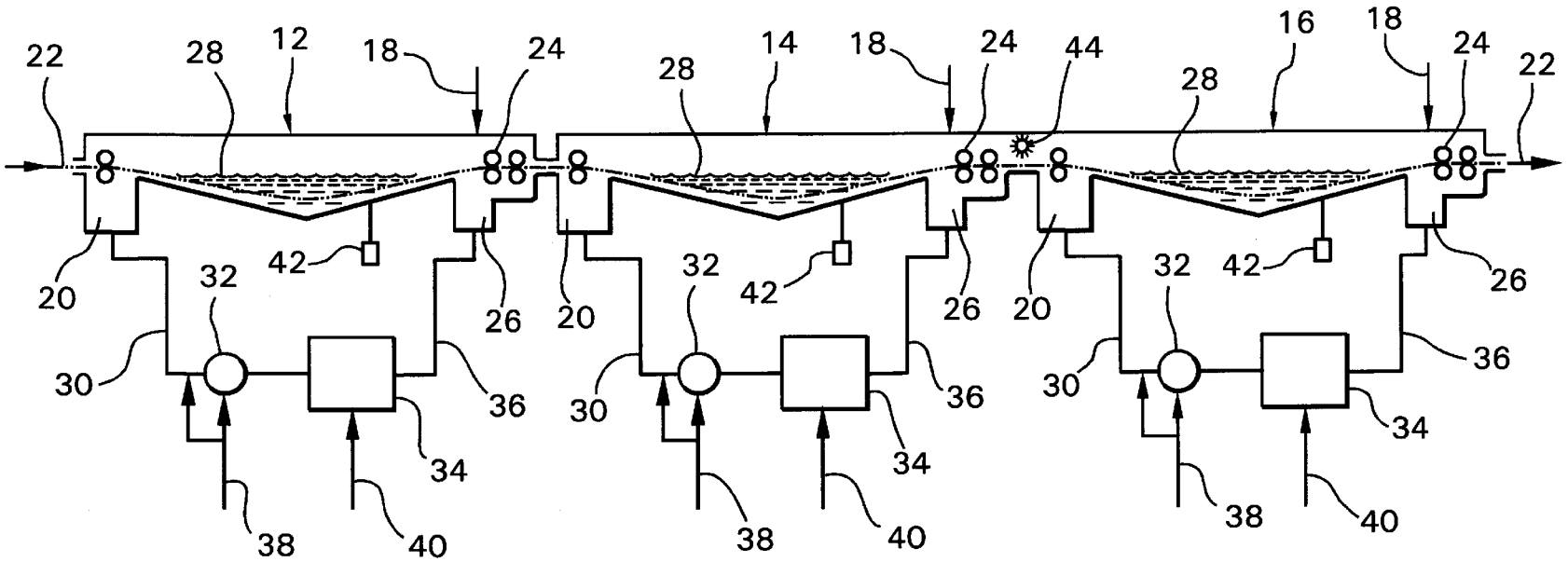
FIG. 1 is a schematic diagram of a pickling tank for pickling a stainless steel strip.

The present invention is directed to a process and apparatus for pickling stainless steel. More particularly, the invention is directed to a process for pickling stainless steel in a bath of a hydrochloric acid solution with reduced pickling times.

The process of the invention uses a hydrochloric acid solution for pickling stainless steel in a manner to reduce the pickling time about 50% compared to the prior stainless steel acid pickling processes. The hydrochloric acid solution contacts the stainless steel to produce ferrous chloride and ferric chloride in the acid solution. The invention is directed to a process of adding an oxidizing agent to the hydrochloric acid solution in an amount to oxidize the ferrous chloride to ferric chloride. Oxidizing the soluble iron to ferric chloride has been found to reduce the pickling time for stainless steel as much as 50% compared to the prior acid pickling solutions used for stainless steel.

The oxidizing agent is added to the hydrochloric acid solution in the pickling tank in an amount to attain the desired reduction in pickling time. In preferred embodiments, the oxidizing agent is added to the hydrochloric acid solution in an amount to oxidize the ferrous chloride to ferric chloride where at least about one third of the soluble iron content in solution is present as ferric chloride based on the total weight of the soluble iron content in solution. Thus, the $Fe^{3+}$concentration in the acid solution is at least one third of the combined weight of the $Fe^{2+}$and $Fe^{3+}$. In further embodiments, the oxidizing agent is added in an amount to maintain a ferric chloride content of at least about 50% by weight based on the total amount of the soluble iron in the acid solution.

In embodiments of the invention, the amount of the oxidizing agent is calculated and added to the pickling acid based on the surface area of the stainless steel being treated in the acid bath to maintain at least about one third of the soluble iron content as ferric chloride based on the total amount of the soluble iron in the acid solution. The feed rate and dimensions of the stainless steel strip and the acid concentration are used to calculate the acid consumption and formation of iron salts, and particularly, the ferric chloride concentration in the acid solution. The amount of the oxidizing agent is added in an amount based on the surface area of the steel to attain the target percent of $Fe^{3+}$. Alternatively, the oxidizing agent can be added in proportion to the weight of the stainless steel being treated by the acid solution. The amount of the oxidizing agent is based on theoretical calculations of the acid consumption and the formation of soluble iron salts based on the average surface area or weight of the stainless steel strip being treated.

The oxidizing agent can be any suitable oxidizing agent capable of oxidizing $Fe^{2+}$to $Fe^{3+}$as known in the art. Examples of suitable oxidizing agents include for example nitric acid, chlorine, hydrogen peroxide and chlorine hydrogen compounds. Other suitable oxidizing agents include acids containing chlorine, such as perchloric acid, chromium oxygen compounds, such as chromium oxide ($CrO_3$), and ferric chloride.

The hydrochloric acid solution is typically a concentrated hydrochloric acid having a pH of about 1.0. In preferred embodiments the hydrochloric acid solution is an azeotropic hydrochloric acid solution such that the acid concentration in the vapor phase is substantially the same as the acid solution in the pickling tanks. An acid concentration greater than an azeotropic mixture results in a high acid concentration in the exhaust fumes which must be removed prior to discharging the fumes to the atmosphere. The hydrochloric acid solution is maintained at a temperature of at least about 40° C. during the pickling process of the stainless steel. In further embodiments, the hydrochloric acid solution is maintained at a temperature at or below the boiling point of an azeotropic hydrochloric acid solution.

The ferric chloride content of the acid pickling solution is determined using standard techniques. For example, in embodiments of the invention, the ferric chloride content of the acid solution is determined by measuring the density of the solution, measuring the conductivity or oxidation reduction potential of the solution by photometric measurements and combinations of these methods. Preferably, the ferric chloride content is maintained within a predetermined range and the oxidizing agent is added to the hydrochloric acid solution based on the measured ferric chloride content to maintain the ferric chloride content within the desired range. The rate and amount of the oxidizing agent added to the acid solution can be adjusted in response to the rate of pickling as determined by the measured ferric chloride or ferric ion content of the acid solution. Thus, the oxidizing agent is added to the hydrochloric acid solution in an amount to maintain the measured ferric chloride content at about one third based on the total iron content and solution. In further embodiments, the oxidizing agent is added to maintain about one half of the soluble iron as ferric chloride.

Referring to FIG. 1, a continuous pickling apparatus is illustrated for use in the process of the present invention. The apparatus as shown includes pickling tanks 12, 14 and 16 connected in series. Each of the pickling tanks include feed rollers 18 at the inlet ends 20 for feeding a continuous strip of stainless steel 22 through the tanks. Discharge rollers 24 are positioned at the outlet end 26 of the tanks to guide the stainless steel strip 22 and support the strip in the hydrochloric acid solution 28. Fresh hydrochloric acid is generally supplied to the downstream tank 16 with respect to the feed direction of the stainless steel strip 22. The acid flows into the tank 16 and overflows or is pumped into the adjacent upstream tank 14. The acid in tank 14 is similarly pumped into the upstream tank 12. The stainless steel strip is feed into the first pickling tank 12 and is carried sequentially through the tanks 14 and 16. The hydrochloric acid removes the scale from the stainless steel to form ferrous chloride and ferric chloride salts in the acid solution. The soluble iron content in the acid in the upstream tank 12 is generally the highest with the iron content decreasing in concentration in tanks 14 and 16, respectively.

The acid solution 28 in preferred embodiments of the invention is an azeotropic hydrochloric acid solution. An azeotropic hydrochloric acid solution is desirable to prevent the escape of high concentrations of hydrogen chloride in the exhaust gases.

The acid solution in each of the tanks 12, 14 and 16 is circulated through a pipe 30 from the upstream end of the tank and is carried by a pump 32 to a recirculation tank 34 where the acid is regenerated or replenished with fresh acid. The acid from the circulation tank 34 is pumped through a pipe 36 and recycled to the discharge end of the respective pickling tank.

The oxidizing agent can be added to the hydrochloric acid in solid form as a powder. Alternatively, the oxidizing agent can be added as a gas or as an aqueous solution. Generally a powdered or gaseous oxidizing agent is more preferred to avoid diluting the pickling acid with the solvent. In preferred embodiments, the oxidizing agent can be supplied to the pipe 30 upstream of the pump 32 such that the suction at the inlet of the pump 32 draws the oxidizing agent into the acid solution and carries the mixture to the recirculation tank 34. The oxidizing agent and the spent acid withdrawn from the pickling tanks are mixed in the recirculation tank 34 to oxidize the ferrous chloride to ferric chloride which is then retuned to the pickling tank. Alternatively, the oxidizing agent can be fed directly into the recirculating tank 34 through a pipe 40. Alternatively, the oxidizing agent can be supplied directly to a separate feed inlet of the pump 32 or supplied with the fresh acid directly into the pickling tank.

A measuring device 42 is provided in each of the pickling tanks to continuously monitor and measure the ferric chloride concentration of the acid solution. The measuring device can be a conventional device capable of continuously monitoring the $Fe^{3+}$concentration. In further embodiments, the measuring device can determine the $Fe^{3+}$concentration at predetermined intervals. The measured ferric chloride concentration is used as a basis to determine the feed rate and the amount of the oxidizing agent added to the hydrochloric acid solution. The measuring device can be coupled to a metering device (not shown) for feeding and controlling the amount of the oxidizing agent added to the hydrochloric acid solution. In preferred embodiments of the invention, the oxidizing agent is added continuously with the circulation of the spent pickling acid to maintain a substantially constant ferric chloride acid solution and to prevent the ferric chloride concentration from falling below the threshold value. Generally, the oxidizing agent is continuously added to the acid solution to maintain at least one third and preferably at least one half of the soluble iron content in the form of ferric chloride based on the total amount of the iron content in the acid solution.

In a further embodiment, brushes 44 can be installed between the individual pickling tanks as shown in FIG. 1 to remove any loose scale adhering to the strip surface. As a result, the pickling time can generally be further reduced by 5–10% in all tests.

Brushes with abrasive particles, such as silicon carbide or aluminum oxide in their bristles, are proven to be a particular advantage. The brushes can be positioned above and below the stainless steel strip to remove scale from both surfaces of the strip.

The following examples demonstrate preferred embodiments of the invention, but are not intended to limit the scope of the invention.

EXAMPLE 1

Pickling tests were conducted on a stainless steel strip of grade AISI 409 in a pickling pilot plant comprising three pickling tanks, each being 20 m long substantially as shown in FIG. 1. The operating conditions for the plant were as follows: $^{st}$, pickling tank 216 g HC1 in total, 85 g dissolved iron, 84 g of which were $Fe^{2+}$and approx. 1 g $Fe^{3+}$, 9 g $Cr^{3+}$/1 $2^{nd}$pickling tank 200 g HC1 in total, 60 g dissolved iron, all in the form of $Fe^{2+}$, and approx. 7 g $Cr^{3+}$/1 $3^{rd}$pickling tank 195 g HC1 in total, 35 g dissolved iron, 33 g of which were $Fe^{2+}$, 2 g $Fe^{3+}$, 4 g $Cr^{3+}$/1

The temperature in all pickling tanks was 80° C. +2° C. The pickling acids were pumped into the pickling tanks at a rate of 150 $m^3$/hr from the circulation tanks assigned to the respective circulation tank through the outlets.

The first stainless steel strip was transported through the pickling tanks at a rate of 30 m/min to provide a pickling time of 120 secs. Minimal pickling was observed after the process. The same strip was pulled through the pickling tanks a second time and then only approximately 50% de-scaling was observed. The strip was not entirely free from scale until it was transported through the pickling tank one more time at a speed of 15 m/min. The overall pickling time was thus approximately 480 sec.

EXAMPLE 2

A pickling plant having three pickling tanks as in Example 1 was used in this example. The chlorine gas was supplied to the circulation tanks and pickling tanks. The composition of the resulting acid solution in each tank was as follows: $1^{st}$ pickling tank 216 g HC1 in total, 85 g dissolved iron, 54 g of which were $Fe^{2+}$and approx. 31 g $Fe^{3+}$, 9 g $Cr^{3+l}$/1 $2_{nd}$pickling tank 200 g HC1 in total, 60 g dissolved iron, 38 g of which were $Fe^{2+}$, 22 g $Fe^{3+}$, 4 g $Cr^{3+}$/1 $3^{rd}$pickling tank 195 g HC1 in total, 35 g dissolved iron, 22 g of which were $Fe^{2+}$, 13 g $Fe^{3+}$, 4 g $Cr^{3+}$/1

The temperature in all pickling tanks was 80° C. +2° C.

At a reduced speed of 15 m/min. the stainless steel strip had to be conveyed through the pickling tanks twice in order to obtain a surface completely free from scale. The overall pickling time was thus unchanged at 480 secs.

EXAMPLE 3

The ferric chloride concentration in the pickling tanks was further increased by adding hydrogen peroxide to the suction pipes leading to the centrifugal pumps for pumping the acid solution through the circulation tank. The composition of the acid solution were adjusted as follows: $1^{st}$ pickling tank 216 HC1 in total, 85 g dissolved iron, 38 g of which were $Fe^{2+}$and approx. 47 g $Fe^{3+}$, 34 g $Fe^{3+}$, 9 g $Cr^{3+}$/1 $2^{nd}$ pickling tank 200 g HC1 in total, 60 g dissolved iron, 26 g of which were $Fe^{2+}$, 34 g $Fe^{3+}$, 7 g $Cr^{3+}$/1 $3^{rd}$pickling tank 195 g HC1 in total 35 g dissolved iron, 15 g of which were $Fe^{2+}$,20 g $Fe^{3+}$, 4 g $Cr^{3+}$/1

The temperature in all pickling tanks was 80° C. +2° C.

The strip was free from scale after passing through the pickling tanks only once at a speed of 15m/min. The overall picking time in this test was only 240 secs.

EXAMPLE 4

The acid solution of Example 3 was adjusted to oxidize substantially all of the soluble iron to $Fe^{3+}$by addition of oxidants in each of the tanks. The stainless steel strip was carried through the pickling baths at 80° C. The pickling time of the stainless steel strip was unchanged from Example 3.

Figure 2:
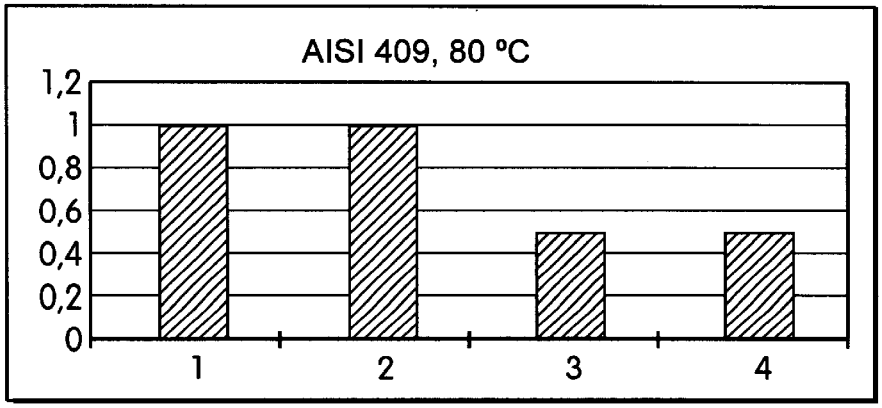
FIG. 2 is a graph showing the comparative pickling time of stainless steel by the addition of an oxidant to the acid solution at a temperature of 80° C.

The table of FIG. 2 shows the results of Examples 1–4 with the pickling times expressed as a fraction based on the pickling time of Example 1. The pickling time of Example 1 was used as a base line for comparing with the pickling time of Examples 2–4.

EXAMPLES 5–8

Figure 3:
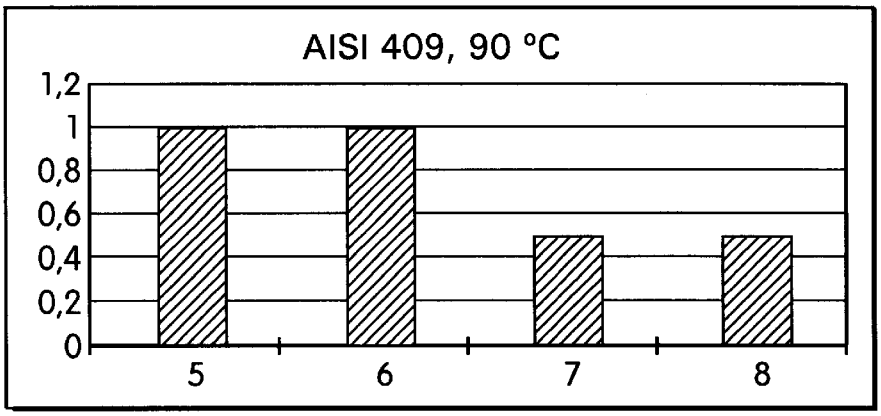
FIG. 3 is a graph showing the comparative pickling time of a stainless steel strip with the addition of an oxidant at a temperature of 90° C.

The concentration of the pickling tanks of Examples 5–8 were adjusted as in Examples 1–4, respectively. The temperatures of the pickling acid was adjusted to 90° C. The pickling times are shown in the table of FIG. 3 and are expressed as a fraction based on the pickling time of Example 5. By increasing the temperature to 90° C., the speed could be increased to 18m/min at the concentrations of Examples 14 with satisfactory pickling. The pickling tanks of Example 7 have the concentrations as in Example 3 provided a pickling time of 200 seconds.

EXAMPLES 9–14

The pickling tanks of Examples 9–14 having initial iron and acid concentrations as in Examples 1–4, respectively were adjusted with perchloric acid to increase the ferric chloride concentration. The amount of perchloric acid added to the acid solution was calculated as a percentage based on the theoretical perchioric acid consumption according to the equation $$8\ FeCl_2 + 7HCl + HClO_4 \rightarrow 8FeCl_3 + 4H_2O$$

Figure 4:
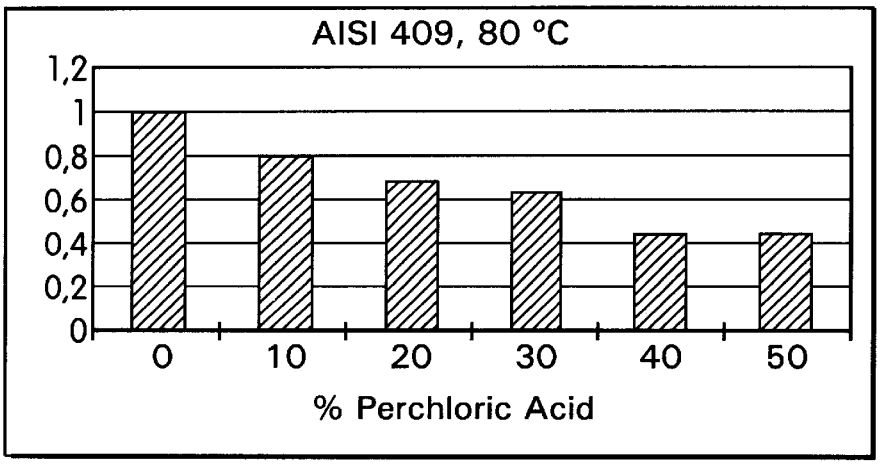
FIG. 4 is a graph showing the comparative pickling times of a stainless steel strip with the addition of perchloric acid.

The pickling times of Examples 10–14 are shown in the table of FIG. 4 as a fraction of the pickling for the acid solution of Example 9, without the addition of perchloric acid. Thus, Example 9 with 0% perchloric acid serves as the base line for calculating the reduction in pickling times. With the successive addition of 10% by volume perchloric acid, the pickling time was also reduced successively. These examples show that at least 50% of the dissolved metals being present in the form of ferric chloride provides improved pickling performance and reduced pickling times.

EXAMPLES 15–18

Figure 5:
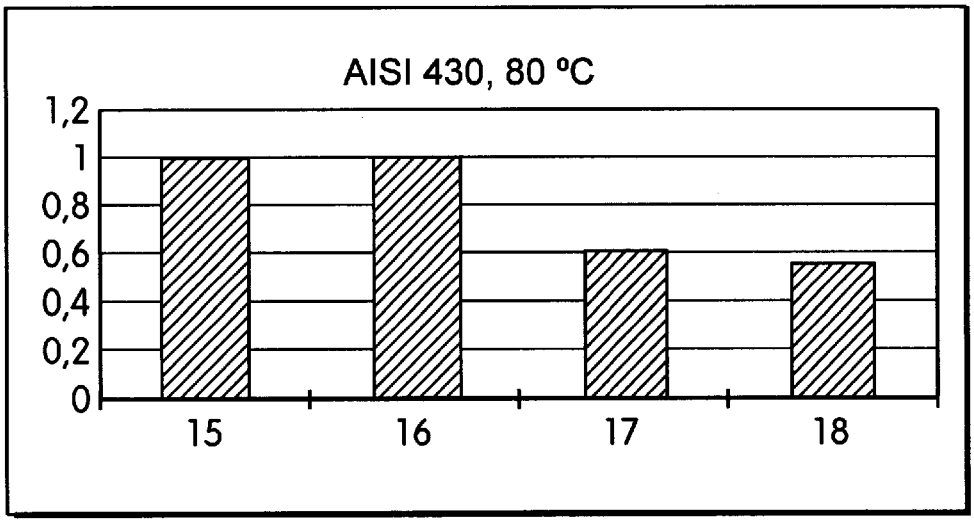
FIG. 5 is a graph showing the comparative pickling times of AISI 430 stainless steel at 80° C.

The pickling tanks of Examples 15–18 were adjusted to the iron and acid concentrations as in Examples 1–4. A stainless steel strip of AISI 430 was transported through the acid solution according to the procedure of Examples 1–4. The comparative pickling times are shown in the table of FIG. 5 using the pickling time of Example 1 as a base line for calculating the improvements in pickling times for Examples 15–18.

EXAMPLES 19–22

Figure 6:
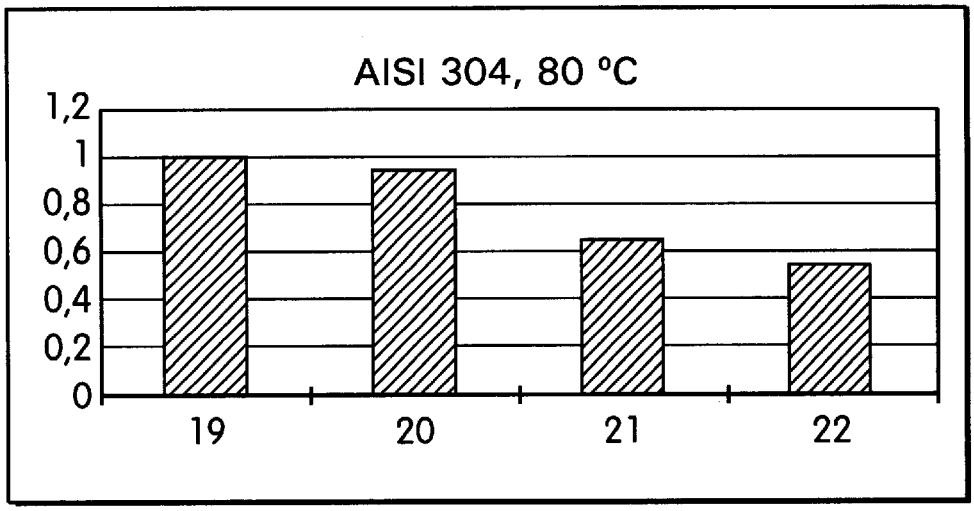
FIG. 6 is a graph showing the comparative pickling times of AISI 304 stainless steel at 80° C.

The pickling tanks of Examples 19–22 were adjusted to the iron and acid concentrations as in Examples 1–4. A stainless steel strip of AISI 304 was transported through the tanks according to the procedures of Examples 1–4. The comparative pickling times are shown in the table of FIG. 6 using the pickling time of Example 1 as a base line for calculating the improvements in pickling time for Examples 19–22.

Various embodiments have been chosen to illustrate the invention. It will be apparent to those skilled in the art that various modification can be made to the process without departing from the invention as defined in the appended claims.

What is claimed:

1. A process for pickling stainless steel comprising the steps of feeding a stainless steel article into a pickling tank containing aqueous hydrochloric acid solution, and pickling said stainless steel article to form $Fe^{2+}$as ferrous chloride ($FeCl_2$) and $Fe^{3+}$as ferric chloride($FeCl_3$) in said hydrochloric acid solution, and continuously adding an oxidant to said hydrochloric acid solution in an amount in proportion to a surface area of the stainless steel article to oxidize said $Fe^{2+}$to $Fe^{3+}$to maintain at least about one third of a total dissolved iron content as ferric chloride in said hydrochloric acid solution, said oxidant being selected from the group consisting of nitric acid, chlorine, hydrogen peroxide, chlorine-oxygen compounds, and ferric chloride.

2. The process of claim 1, wherein said aqueous hydrochloric acid solution is at a temperature below the boiling point of an azeotropic hydrochloric acid solution.

3. The process of claim 1, wherein said chromium-oxygen compound is a chromate.

4. The process of claim 1, wherein said chlorine-oxygen compound is a chlorine containing acid.

5. The process of claim 1, comprising adding said oxidant in an amount to maintain at least about one half of said total dissolved iron content in said hydrochloric acid solution as ferric chloride.

6. The process of claim 1, comprising the step of measuring a content of said ferric chloride of said hydrochloric acid solution by measuring the density, conductivity, or oxidation reduction potential, by photometric analysis of said hydrochloric acid solution or a combination thereof

7. The process of claim 1, comprising determining the surface area of said stainless steel article being pickled by said hydoloric acid solution and adding said oxidant in an amount based on said surface area.

8. The process of claim 1, comprising determining the weight of said stainless steel article being pickled by said hydrochloric acid solution and adding said oxidant to said hydrochloric acid solution in an amount based on said weight.

9. The process of claim 1, wherein said pickling tank includes a circulating pump to circulate said hydrochloric acid solution from an outlet pipe of said tank to an inlet pipe of said tank, and said method comprises adding said oxidant to said outlet pipe.

10. The process of claim 1, wherein said pickling tank including a circulating tank and said process comprises supplying said oxidant to said pump to feed said oxidant directly into said hydrochloric acid solution.

11. The process of claim 1, comprising pumping said hydrochloric acid solution from said pickling tank to a circulation tank and adding said oxidant to said circulation tank to oxidize $Fe^{2+}$to $Fe^{3+}$.

12. The process of claim 1, comprising feeding said stainless steel article through a plurality of said acid pickling tanks arranged adjacent each other and mechanically cleaning a surface of said article between adjacent pickling tanks.

13. The process of claim 6, comprising adding said oxidant to said hydrochloric acid solution based on said measured ferric chloride content to provide a ferric chloride content of said at least one third based on said total dissolved iron content in said hydrochloric acid solution.

14. The process of claim 12, comprising brushing said surface of said article between adjacent pickling tanks to remove scale from said surface.

15. A process of pickling a stainless steel strip comprising:

providing a plurality of adjacent tanks arranged in series, each said tank containing an aqueous hydrochloric acid solution, feeding a continuous stainless steel strip through said aqueous hydrochloric acid solutions in each of said pickling tanks to pickle the surface if said strip thereby forming $Fe^{2+}$as ferrous chloride ($FeCl_2$) and $Fe^{3+}$as ferric chloride ($FeCl_3$) in said aqueous hydrochloric acid solution, and continuously supplying an oxidant to said aqueous hydrochloric acid solution in each of said pickling tanks in an amount to oxidize at least a portion of $Fe^{2+}$to $Fe^{3+}$and to maintain a ferric chloride content of at least about one third based on a total soluble iron content in each of said aqueous hydrochloric acid solutions in a pickling tanks, wherein said oxidant is selected from the group consisting of nitric acid, chlorine, hydrogen peroxide, chlorine-oxygen compounds, and ferric chloride.

16. The process of claim 15, wherein said aqueous hydrochloric acid solution in each of said pickling tanks is maintained at a temperature of at least about 40° C.

17. The process of claim 15, wherein said oxidant is a chromate.

18. The process of claim 15, wherein said oxidant is a chlorine containing acid.

19. The process of claim 15, wherein said oxidant is included in an amount to maintain said ferric chloride content of at least about one half based on said total soluble iron content in said aqueous hydrochloric acid solution.

20. The process of claim 15, comprising the step of measuring the ferric chloride content in said aqueous hydrochloric acid solution by measuring the density, conductivity, or oxidation reduction potential by photometric analysis of said aqueous hydrochloric acid solution or combination thereof, and adding said oxidant to said aqueous hydrochloric acid solution based on said measured ferric chloride content.

21. The process of claim 15, comprising determining a weight of said stainless steel article being pickled by said aqueous hydrochloric acid solution and adding said oxidant in an amount based on said surface area.

22. The process of claim 15, comprising determining a weight of said stainless steel article being pickled by said aqueous hydrochloric acid solution and adding said oxidant to said aqueous hydrochloric acid solution in an amount based on said weight.

23. The process of claim 15, wherein said acid pickling tanks include a circulating pump to circulate said aqueous hydrochloric from an outlet pipe of said pickling tank to an inlet pipe of said pickling tank, and said method comprising adding said oxidant to said outlet pipe.

24. The process of claim 15, wherein each of said aqueous hydrochloric acid solution from an outlet pipe to an inlet pipe of said pickling tank, and said method comprises supplying said oxidant to said oxidant to said pump to feed said oxidant directly into said aqueous hydrochloric acid solution.

25. The process of claim 16, wherein said oxidant is included in an amount to maintain said ferric chloride content of at least about one half based on said total soluble iron content in said aqueous hydrochloric acid solution.

* * * * *